United States Patent [19]

Maurice

[11] Patent Number: 5,054,706

[45] Date of Patent: Oct. 8, 1991

[54] DEVICE TO ADJUST AND DISPENSE WEBS OF ROLLED UP MATERIAL

[76] Inventor: Granger Maurice, 17 Rue Marcel Pagnol, 42270 Saint Priest en Jarez, France

[21] Appl. No.: 499,211

[22] Filed: Mar. 19, 1990

Related U.S. Application Data

[63] Continuation of Ser. No. 251,844, Oct. 3, 1988, abandoned.

[30] Foreign Application Priority Data

Oct. 2, 1987 [FR] France ..... 87 14069

[51] Int. Cl.[5] ..... B65H 16/04; B65H 23/16

[52] U.S. Cl. ..... 242/55.200; 242/75.450

[58] Field of Search ..... 242/18 DD, 55.2, 55.3, 242/64, 65, 75.45, 75.46, 151

[56] References Cited

U.S. PATENT DOCUMENTS

| | | | |
|---|---|---|---|
| 2,924,494 | 2/1960 | Sloier | 242/55.2 X |
| 3,661,334 | 5/1972 | Graf | 242/18 DD |
| 3,672,584 | 6/1972 | Macedo et al. | 242/18 DD X |
| 4,008,114 | 2/1977 | Lindsey | 242/75.45 X |
| 4,140,286 | 2/1979 | Lattion | 242/18 DD |
| 4,150,797 | 4/1979 | Kataoka | 242/75.2 X |
| 4,342,429 | 8/1982 | Katoh et al. | 242/18 DD |
| 4,552,315 | 11/1985 | Granger | 242/55.3 |
| 4,621,755 | 11/1986 | Granger | 225/96 |
| 4,684,074 | 8/1987 | Whiteley | 242/18 DD |
| 4,846,035 | 7/1989 | Granger | 83/337 |

FOREIGN PATENT DOCUMENTS

| | | | |
|---|---|---|---|
| 2406122 | 8/1974 | Fed. Rep. of Germany | 242/18 DD |
| 258014 | 9/1926 | United Kingdom | 242/18 |

*Primary Examiner*—Daniel P. Stodola
*Assistant Examiner*—William G. Battista, Jr.
*Attorney, Agent, or Firm*—Eric P. Schellin

[57] ABSTRACT

Device wherein the support arm (3) elastically hinged on the base plate (1) with wall fixing for the unit in order to constantly apply the roll of material (R) against the drive drum (5) with a non-slip surface, is fitted with a device comprising a first element (6) fixed onto the arm, and a second element (7) fixed so as to swing on the base plate with return elastically in the direction of the first element; these elements being judiciously positioned and profiled in their contact zone in order to provide dispensing with substantially constant pressure of the roll of material on the drive drum throughout the unrolling operation.

1 Claim, 2 Drawing Sheets

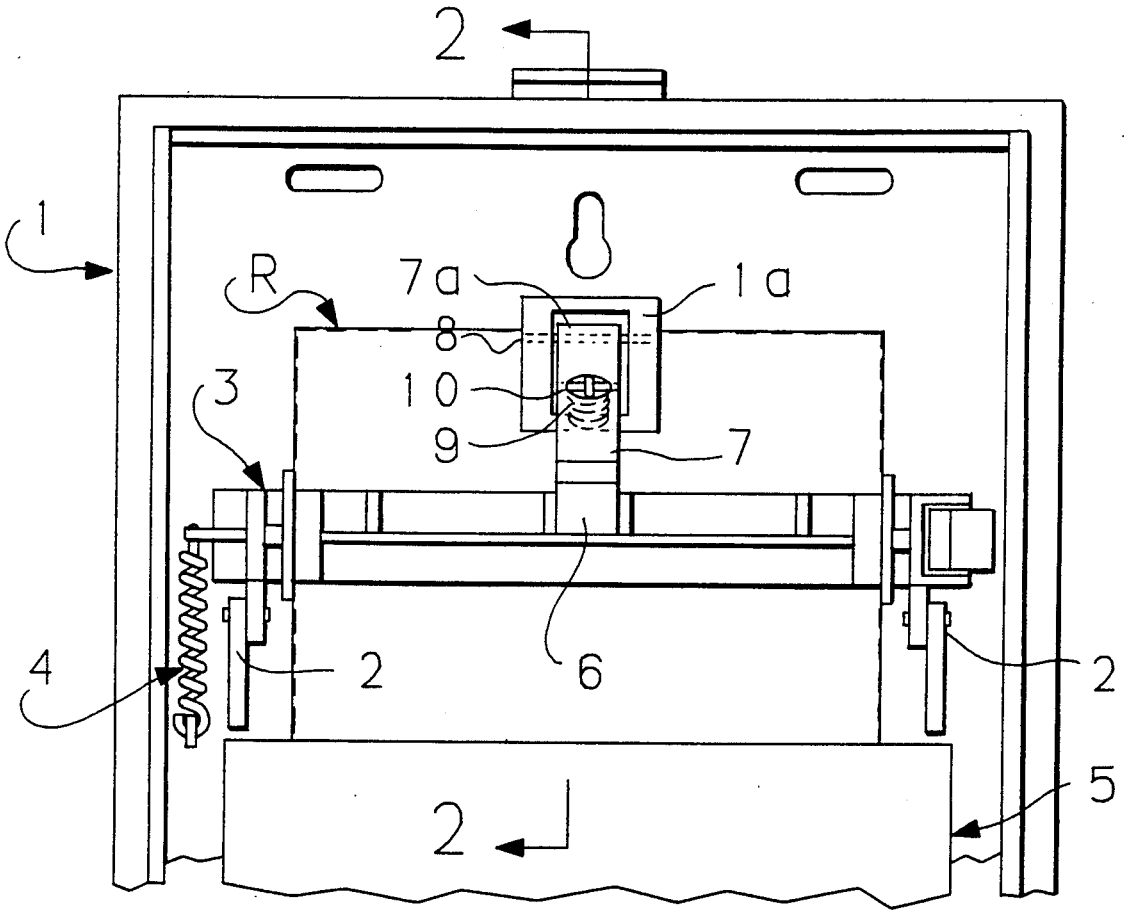
Fig. 1
Fig. 2
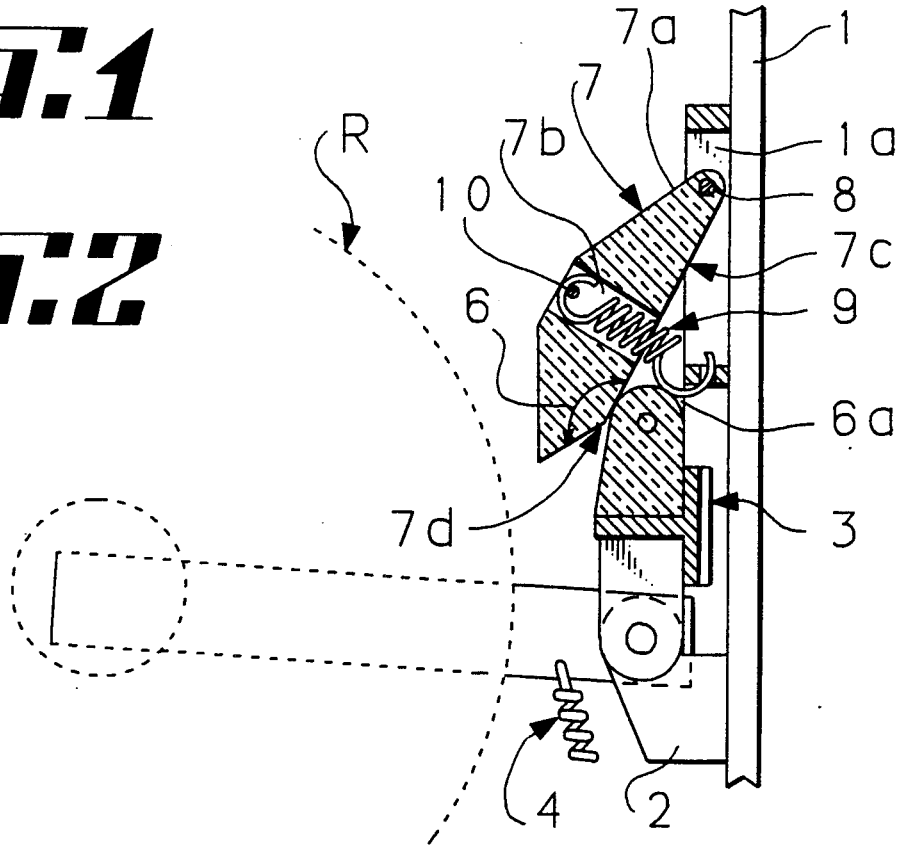

DEVICE TO ADJUST AND DISPENSE WEBS OF ROLLED UP MATERIAL

This application is a continuation of application Ser. No. 251,844, filed Oct. 3, 1988, now abandoned.

BACKGROUND OF THE INVENTION

The invention relates to a device to adjust and dispense webs of rolled up material. The object of the invention relates to the technical sector of dispensing devices for lengths of materials rolled up on reels. The invention is applied to in particular, however, not exclusively, paper, cotton wool and similar wiping materials.

FIELD OF THE INVENTION

The unit fitted with the device, is for example, of the type according to which a roll of wiping material, mounted so as to turn freely on a wall support, is directly pressed against a drum with a non-slip surface, so that, by simple pulling by hand, the web of material projecting from the unit, is distributed and detached automatically, the length of the web being sensitively equal to the diameter of the drum. This is carried out through a cutting device associated and cooperating with various additional components, placed in relation with the drum and the wall support; a new web of material automatically projecting under the unit after the material has been cut.

DESCRIPTION OF THE RELATED ART

According to the invention, we wanted to, once again, improve the operation of this type of unit which is covered by several patent filings or certificates of addition of which the applicant is also the holder.

In particular, we aimed at avoiding any detrimental resistance to the dispensing operation, for example, in the case of thin hand-wiping materials being pulled with wet hands.

We also wanted to provide evenness of the pulling force of the paper regardless of the degree of use of the roll of material. In fact, it was ascertained, that for certain types of non-used rolls, pulling forces in the region of 1 to 1.2 kg were required on the end of the pulled web in order for it to be unrolled.

Contrary to this, when the rolls of material were used, for the most part, the pulling force is less and can be hindering. Therefore, the aim sought after was to find a way of adjusting this pulling force.

SUMMARY OF THE INVENTION

With this in mind and according to a first feature, the elastically hinged support arm on the base plate with wall fixing of the unit in order to constantly apply the roll of material against the drive drum with non-slip surface, is fitted with a device comprising a first element fixed on the arm and a second element mounted so as to oscillate on the base plate with elastic means returning in the direction of the first element; these elements being judiciously positioned and profiled in their contact zone so as to provide dispensing with sensitively constant pressure for the roll of material on the drive drum throughout the unrolling operation. These features and others will appear as the specification proceeds.

BRIEF OF THE DRAWINGS

In order to clarify the object of the invention, however, without limiting it, the invention is illustrated by the accompanying drawings:

FIG. 1 is a partial front view with the housing removed, illustrating a unit fitted with the device according to the invention;

FIGS. 2, 3 and 4 are partial sections taken on the line 2.2 of FIG. 1, showing the characteristic positions of the adjusting device.

Figure 3:
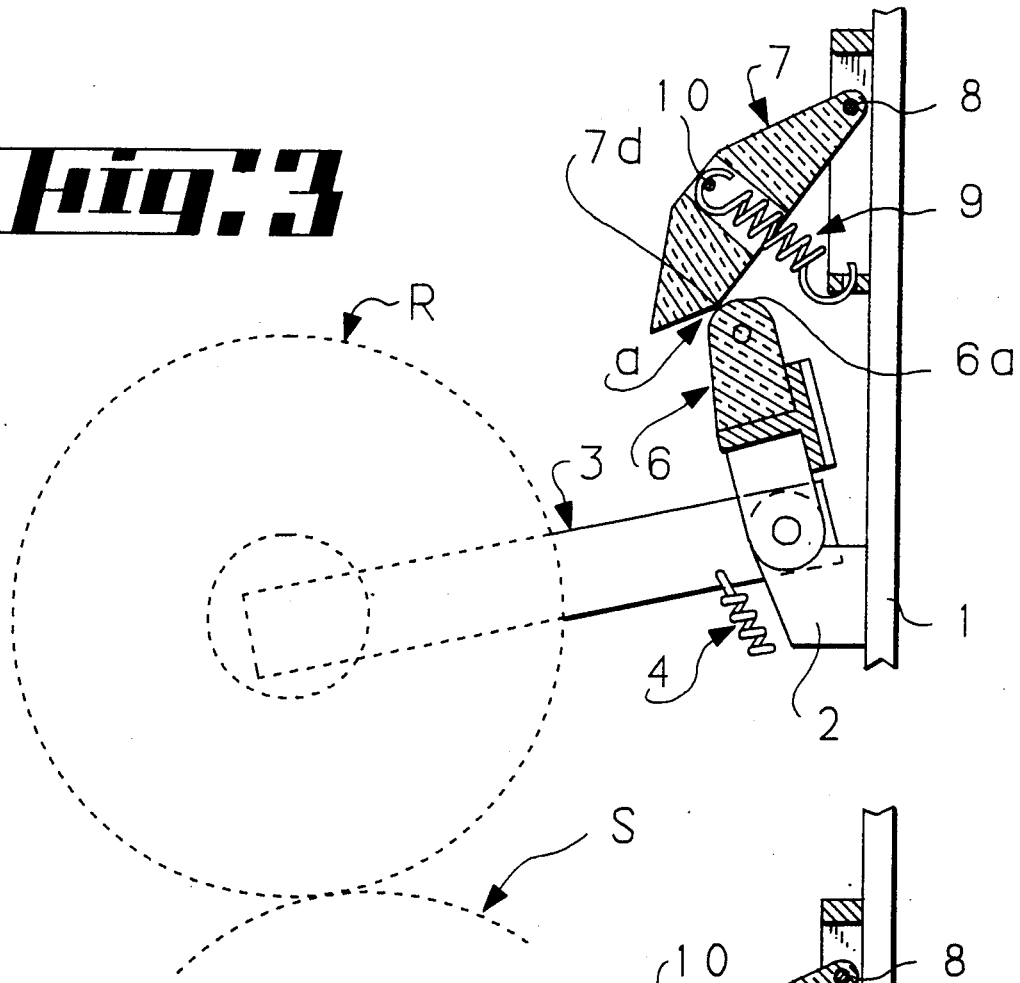

The object of the invention will become more apparent from the following non limiting detailed description, when considered in conjunction with the accompanying drawings.

DETAILED DESCRIPTION OF THE INVENTION

FIG. 1 shows a unit comprising a base plate (1) with wall fixing on which a support arm (3) is hinged in for a roll (R) of material shown in the form of dashes in order to clarify the drawing. A spring (4) attached to the said arm and the base plate, provides the constant return of the roll on the drum (5) with non-slip surface which is partially represented schematically considering that the mechanisms associated to the drum with a view to the simultaneous dispensing and cutting of the web of material can be of any nature or were extensively described in the previous patents of the applicant.

In the middle part of the support arm (3) there is a first element (6) which is fixed by any means or directly formed, its top part (6*a*) has a convex profile with an edge (a) connecting at the front with its face, comprising a contact generating line with a second element (7) which is hinged by a pin (8) at its top part (7*a*) on the base plate (1) comprising, for this purpose, an open base plate (1*a*). Element (7) which is substantially in its central zone, has a crosswise through opening (7*b*) crossed by a helical spring (9) which is attached at one point (10) of the said base plate (1) and is weaker than the return spring (4) of the support arm.

Element (7) has a rear face (7*c*) forming approximately $\frac{2}{3}$ of its length going from hinge (8), a very open angle (b) whose rounded apex (7*a*) makes up a characteristic point of the operation as shall be made apparent as the description proceeds.

By referring to FIGS. 2, 3 and 4, the operation of the device will now be described.

When a new roll is placed on the support arm and pressed against the drum, its diameter is such that the top part (6*a*) of element (6) is situated between the apex (7*d*) and end (7*a*) of element (7). In this position, illustrated in FIG. 2, the return spring (9) of element (7) is fully urged on element (6) particularly on its edge (a) thus reducing the return force of spring (4) of the support arm (3). This results in the heavier roll of material being applied against the drum with light pressure enabling unrolling without substantial force.

Figure 4:
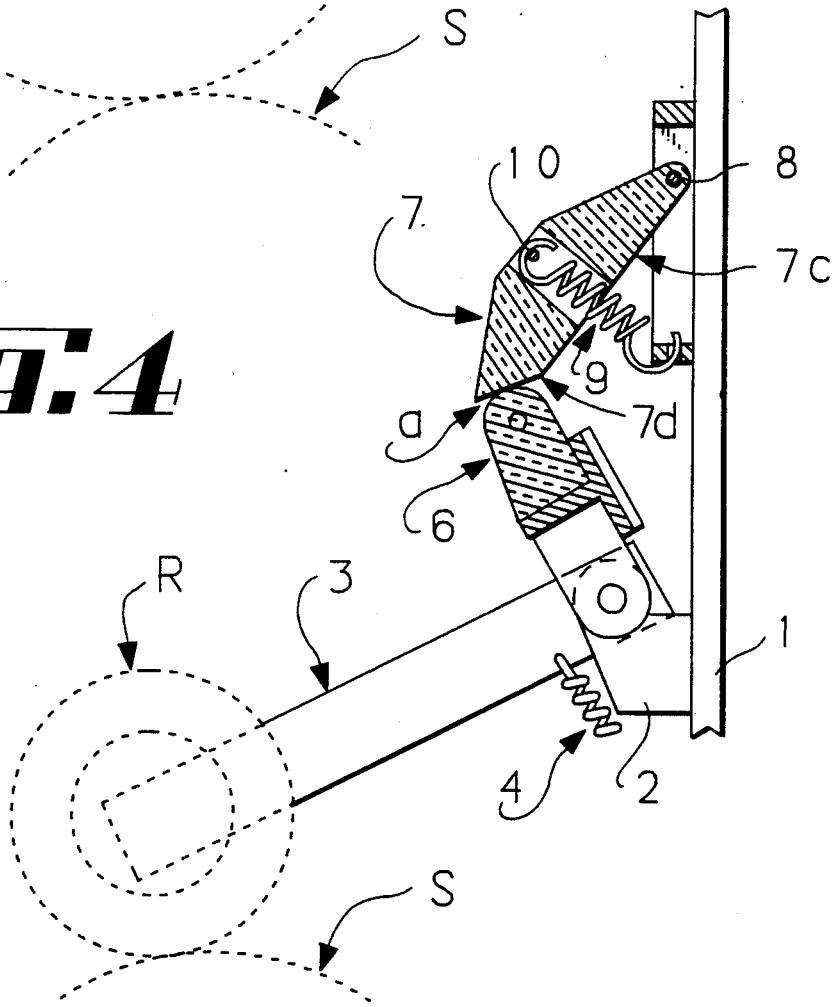

When roll (R) reaches a given diameter corresponding for example, to a half way mark of unrolling, the profiled part (6*a*) of element (6) comes sensitively to the level of the rounded apex (7*d*) of element (7) which makes up the tipping point of the forces (FIG. 3).

As soon as part (6*a*) of element (6) passes infront of the rounded apex (7*d*) of element (7), i.e. between the said apex and the free end, the pressure of spring (9) is added to the pressure of spring (4) thus compensating the reduction in the weight of the roll.

By judiciously combining the spring settings, the shapes and positionings of the elements (6) and (7) in function of the characteristics of the roll, a sensitively constant pressure can thus be provided throughout the unrolling operation, therefore, even dispensing under all circumstances and with all types of wiping materials. The pulling effort required can be in the region of 450 to 500 grammes.

I claim:

1. A dispenser for dispensing web material from a roll of web material including means for varying the pressure applied to said roll of web material in proportion to the diameter of the roll comprising:

the dispenser having a vertical wall, two horizontally spaced ears attached to and extending perpendicularly from the said vertical wall, a first L-shaped lever, a second L-shaped lever, said first L-shaped lever being hingedly attached proximate its elbow to one of said ears, said second L-shaped lever being hingedly attached proximate its elbow to the other of said ears, an axle, said axle being journalled between the longer legs of the first L-shaped lever and the second L-shaped lever, whereby a roll of web material may be rotatably mounted on said axle when said device is employed, a rotatable drum having a friction producing surface mounted in said dispenser parallelly below the roll of web material and in frictional engagement with the roll of web material when said device is employed, at least one first spring having one end attached to a longer leg of one of said L-shaped levers and the other end being attached to said vertical wall whereby the longer leg of said L-shaped lever is urged arcuately in a direction towards said drum, the shorter leg of said L-shaped levers terminating in a convex cam surface, a second lever, hinge means for pivotally mounting said second lever on said vertical wall, said second lever journalled at one end to said hinge means, a second spring having one end attached to said vertical wall and the other end attached to the second lever, said second lever having a cam surface at the other end, said second spring urging the cam surface of the second lever against said convex cam surface of said shorter leg of said second L-shaped lever thereby to diminish the pull of the first spring on the long leg of the second L-shaped lever when the roll of web material has more wound up web material and greater pull when the roll of web material has less wound up web material.

* * * * *